United States Patent [19]

Roesler

[11] 4,441,771

[45] Apr. 10, 1984

[54] DRAWER APPARATUS

[76] Inventor: Layton S. Roesler, 3515Mound St., Ventura, Calif. 93003

[21] Appl. No.: 346,483

[22] Filed: Feb. 8, 1982

[51] Int. Cl.[3] ..... A47B 88/00; A47B 88/18

[52] U.S. Cl. ..... 312/322; 312/323; 312/327; 312/330 R

[58] Field of Search ..... 312/322, 323, 324, 326, 312/327, 333, 330 R, 348

[56] References Cited

U.S. PATENT DOCUMENTS

| | | | |
|---|---|---|---|
| 321,078 | 6/1885 | Birckhead | 312/323 |
| 651,739 | 6/1900 | Woodruff | 312/323 |
| 1,052,778 | 2/1913 | Wells | 312/333 |
| 2,839,349 | 6/1958 | Culver | 312/323 |
| 3,716,282 | 2/1973 | Propst et al. | 312/322 |
| 3,975,071 | 8/1976 | Quinn | 312/323 |
| 4,314,734 | 2/1982 | Grunert | 312/322 |

*Primary Examiner*—Victor N. Sakran
*Attorney, Agent, or Firm*—Jack C. Munro

[57] ABSTRACT

A drawer which is to be readily mounted to the undersurface of a shelf, cabinet or table, which is to be movable between a closed position and an open position. With the drawer in the open position, it assumes an inclined position to facilitate access into the internal compartment of a drawer. Secured to the exterior surface of each side wall of the drawer is a protruding member. Each protruding member is to fall within a recess, when in the open position, which is formed within a side rail assembly which mounts the drawer to the undersurface of the shelf, cabinet or table. With the drawer in the closed position, a separate locking means is engaged which prevents unauthorized movement of the drawer from the closed position to the open position.

5 Claims, 6 Drawing Figures

DRAWER APPARATUS

BACKGROUND OF THE INVENTION

The field of this invention relates to drawers, and more particularly to the structure associated with the mounting and supporting of a drawer to facilitate the movement of the drawer between the open and the closed position.

Within confined quarters environments, there is always the need for additional storage space. An example of the confined quartered storage space would be a camper or a small kitchen in a house. In both such environments, there are always available cabinets, tables, or any other type of structure which includes a bottom planar surface, which is spaced from the floor of the camper or the house.

One way in which storage space can be increased is by mounting an additional drawer to the bottom surface of the cabinet, shelf or table. It is to be understood that a drawer is an enclosing side wall structure which is movable between a retracted or closed position and an open position. The open position permits access into the interior compartment of the drawer. The closed position is when the internal compartment of the drawer is covered by the bottom surface of the cabinet, shelf or table and the drawer is located "out of the way".

SUMMARY OF THE INVENTION

The primary objective of this invention is to construct a drawer assembly which can be readily and quickly mounted by relatively unskilled individuals within an existing environment, such as in a camper (commonly known as a recreational vehicle), within a house or other similar type of structure.

Another objective of this invention is to construct a drawer apparatus, which in the closed position, is located "out of the way" and is not a hindrance to the user when performing other duties or movements in the area that the drawer apparatus is located.

Another objective of the drawer apparatus of this invention is that when the drawer is in the open position, access to within the interior compartment of the drawer is facilitated regardless of its "out of the way" mounting.

The drawer apparatus of this invention is mounted by a pair of side rails. The inner facing surface of each side rail includes a cam surface. Within each cam surface, directly adjacent the front edge of each side rail is a recess. Mounted on the exterior surface of each side wall of the drawer is a guide rail. Also mounted on the exterior surface of each side wall is a protruding member. Each protruding member is located directly adjacent the back wall of the drawer. Each guide rail is to slidably connect with a cam surface to facilitate sliding movement of the drawer between the closed position and open position. When in the open position, each protruding member is to fall within its respective recess to not only permit complete disengagement of the drawer from the side rails but also to permit the drawer to be tilted to an inclined position to facilitate access into the interior compartment of the drawer. When the drawer is in the completely closed position, there is a locking mechanism engaged to prevent unauthorized (accidental) movement of the drawer to the open position. The locking mechanism is to be readily manually disengaged prior to opening of the drawer. When open, the structure of the drawer of the invention is usable at a height that would not be feasable without the inclined feature, as one could not see contents of the drawer to select items therein. This adds to usability because the drawer can be mounted in wasted space inside kitchen cabinets, or securing it to bottoms of shelfs, etc.

BACKGROUND OF THE INVENTION

Figure 1:
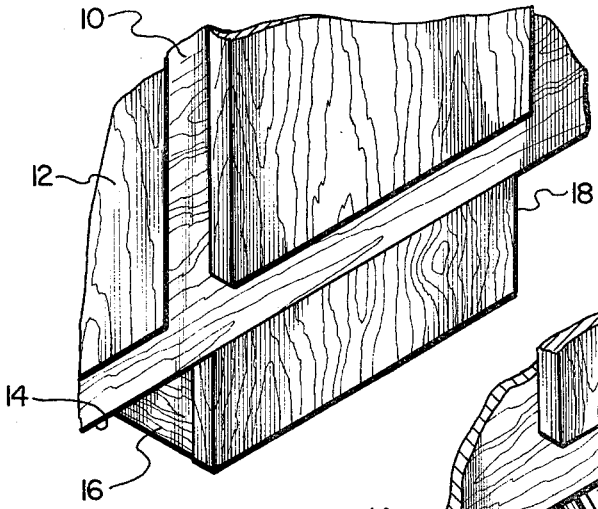
FIG. 1 is an isometric view showing the drawer of this invention as it would be mounted in typical installation beneath a cabinet, with the drawer in the closed position.

Referring particularly to the drawing, there is shown a cabinet 10 which includes conventional cabinet doors 12 which is closed by a bottom surface 14.

Fixedly secured by appropriate fastening means (not shown) to the bottom 14 are a pair of side rails 16 and 18. Side rails 16 and 18 are spaced apart a predetermined amount. Each of the side rails 16 and 18 have facing inner surfaces. These inner surfaces are configured substantially identical, with the exception that they are a mirror image of each other.

The inner surface of the side rail 16 includes a planar ledge which forms a cam surface 20. A similar planar ledge 22 is formed on the inner surface of the side rail 18. The ledges 20 and 22 are to function as a cam surface as will be explained further on in the specification.

Formed within the ledge 20 and located directly adjacent the front edge 24 of the side rails 16 is a recess 26. It is to be noted that the recess 26 is slanted toward the front edge 24.

In a similar manner, there is a recess 28 formed within the ledge 20 which is also located directly adjacent the front edge 30 of the side rail 18. The recess 28 is also slanted toward the front edge 30.

A drawer 32, which takes the form of a front wall 34 and a back wall 36 which are connected together through side walls 38 and 40, has an internal compartment 42. The internal compartment 42 is closed at its lower end by means of a bottom wall 44. There may be included within the compartment 42 a plurality of compartment dividers 46. These compartment dividers 46 will normally be located in place within grooves formed within the inner surfaces of front wall 34, the back wall 36 and the side walls 38 and 40. The dividers 46 may be located in a crossed relationship and some also located in a parallel relationship.

The exterior surface of the side wall 40 has fixedly mounted there on a guide rail 48 which has a contacting surface 50. A similar guide rail 52 is attached to the exterior surface of the side wall 38, with the guide rail 38 also having a contacting surface 54. The surface 56 of the guide rail 48 which is nearest the back wall 36 is slanted at a prescribed angle. The surface 58 of the guide rail 52, which is located nearest the back wall 36, is also similarly slanted.

Located directly adjacent to, but spaced from, the surface 56 is a protruding member 60. The member 60 is fixedly secured to the exterior surface of the side wall 40. A similar protruding member 62 is mounted on the exterior surface of the side wall 38 directly adjacent to but spaced from the slanted surface 58. It is to be noted that if the contacting surface 50 were extended, it would be tangent to the protruding member 60. In a similar manner, the contacting surface 54 would be tangent to the protruding member 62.

The drawer 32 is to be positioned within the space between the side rails 16 and 18, with the contacting surface 50 abutting ledge 20 and the contacting surface 54 abutting ledge 22. When the drawer 32 is in the closed position, which is when the bottom surface 14 of the cabinet closes the compartment 42, a tit 64 is to engage with recess 26. The tit 64 is formed as part of side rail 48 and protrudes outwardly from the contacting surface 50. The tit 64 is located directly adjacent the front wall 34. The cooperation between the tit 64 and the recess 26 is to function as a locking means to maintain the drawer 32 in the closed position. The drawer 32 must be manually lifted or moved toward the bottom surface 14 a small distance so as to disengage the tit 64 from the recess 26 to then permit the drawer 32 to be moved to the open position. It is to be understood that there will be a similar tit associated between the rail 52 and the ledge 22 which is to engage with recess 28.

Figure 2:
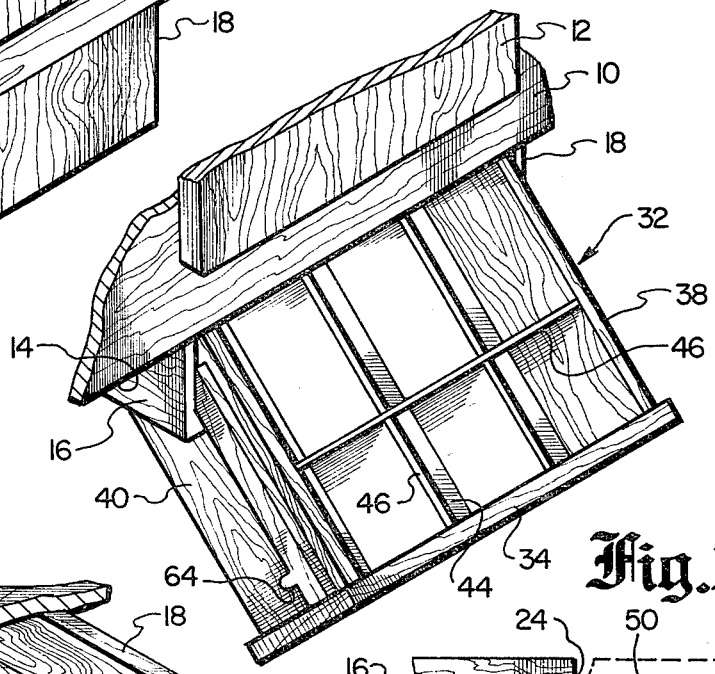
FIG. 2 is a view similar to FIG. 1, but showing the drawer in the open position.
Figure 3:
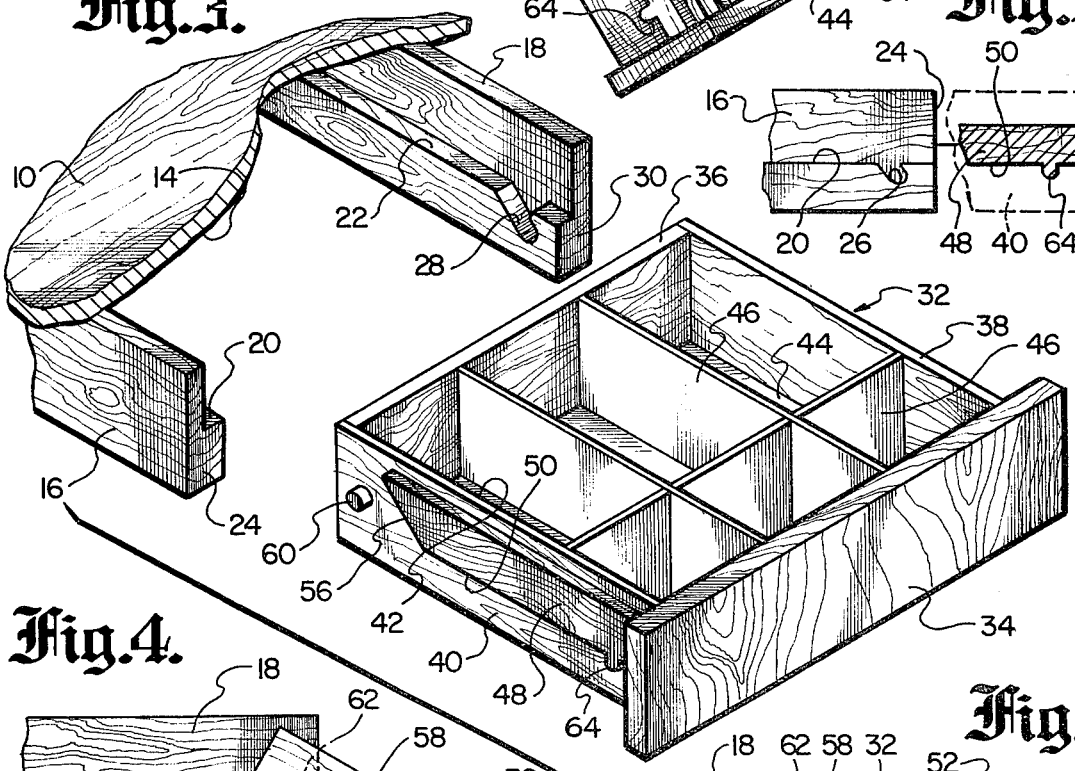
FIG. 3 is an exploded, isometric view showing the drawer separated from its mounting side rail assembly.
Figure 6:
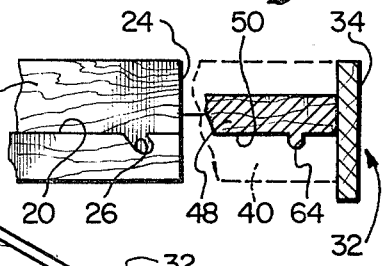
FIG. 6 is an exploded, partly-in-cross-section, side view showing the locking means utilized to lock the drawer apparatus when in the closed position.
Figure 4:
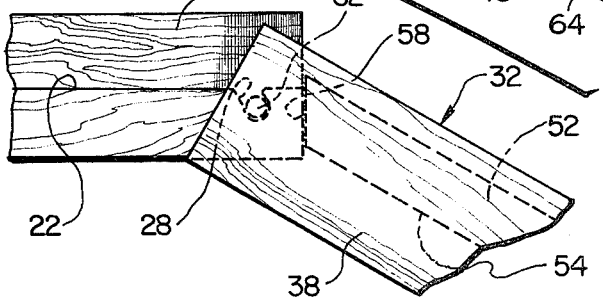
FIG. 4 is a segmental side view diagrammatically showing the position of the drawer apparatus with the drawer in the open position.
Figure 5:
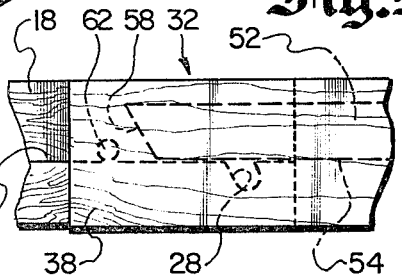
FIG. 5 is a view similar to FIG. 4 but showing the position of the drawer apparatus being moved from the open position to the closed position.

As the drawer 32 is moved toward the open position and when almost fully extended the protruding members 60 and 62 will fall within their respective recesses 28 and 26. At that time, upon the operator releasing the drawing 32, the entire drawer 32 will pivot to assume an inclined position as is shown within FIGS. 2 and 4 of the drawing. When in the inclined position, the surfaces 56 and 58 will rest against respectively, the front edges 24 and 30, thereby preventing further pivotal movement. This inclination of the drawer 32 is so as to facilitate access into the internal compartment 42 where articles (not shown) are to be stored. The reason that it is desired to so incline the drawer 32 is that the drawer 32 may be located in relatively inaccessible locations, as near a ceiling or under a table. This inclining of the drawer 32 is so as to make it easy to remove articles or place new articles within the compartment 42.

What is claimed is:

1. A drawer apparatus comprising:

a side rail assembly comprised of a pair of substantially parallel spaced-apart side rails, each said side rail having an inner surface, said inner surfaces facing each other, each said side rail having a cam surface, each said cam surface including a recess, each said side rail terminating at a front edge;

a drawer having an internal compartment enclosed by a front wall and a back wall interconnected by a pair of spaced-apart side walls, each said side wall having an exterior surface, each said exterior surface having a guide rail, each said guide rail extending from said front wall to a surface located directly adjacent said back wall but spaced therefrom, a said guide rail to slidably connect with a said cam surface to permit movement of said drawer relative to said side rail assembly, said movement of said drawer being between a closed position and an open position, said closed position not permitting access into said internal compartment, said open position permitting access into said internal compartment; and a protruding member mounted on each said exterior surface with there being two in number of said protruding members, each said protruding member being located between its respective said surface and said back wall, each said protruding member to engage with a said recess when said drawer is in said open position, said protruding members and said recesses preventing disengagement of said drawer from said side rail assembly when in said open position, upon said drawer reaching said open position the entire said drawer pivots to an inclined position (relative to said closed position) with each said surface of each said guide rail abutting said front edge of a said side rail.

2. The drawer apparatus as defined in claim 1 wherein:

each said cam surface being substantially planar.

3. The drawer apparatus as defined in claim 2 wherein:

each said protruding member being substantially in line with a said guide rail.

4. The drawer apparatus as defined in claim 3 including:

locking means mounted on said drawer and said side rail assembly, said locking means being engaged when said drawer is in said closed position to prevent unauthorized movement of said drawer to said open position.

5. The drawer apparatus as defined in claim 4 wherein:

said locking means comprising a tit assembly which is to connect with at least one of said recesses.

* * * * *